US007708529B2

(12) United States Patent
Klingels

(10) Patent No.: US 7,708,529 B2
(45) Date of Patent: May 4, 2010

(54) ROTOR OF A TURBO ENGINE, E.G., A GAS TURBINE ROTOR

(75) Inventor: Hermann Klingels, Eching (DE)

(73) Assignee: MTU Aero Engines GmbH, Munich (DE)

( * ) Notice: Subject to any disclaimer, the term of this patent is extended or adjusted under 35 U.S.C. 154(b) by 1006 days.

(21) Appl. No.: 11/255,560

(22) Filed: Oct. 20, 2005

(65) Prior Publication Data

US 2006/0083621 A1 Apr. 20, 2006

(30) Foreign Application Priority Data

Oct. 20, 2004 (DE) ..... 10 2004 051 116

(51) Int. Cl.
*B64C 11/04* (2006.01)

(52) U.S. Cl. ..... 416/220 R; 416/248

(58) Field of Classification Search ..... 416/215, 416/218, 219 R, 220 R; 29/889.21
See application file for complete search history.

(56) References Cited

U.S. PATENT DOCUMENTS

| | | | | | |
|---|---|---|---|---|---|
| 876,971 | A | * | 1/1908 | Junggren | 416/215 |
| 2,220,918 | A | * | 11/1940 | Smith | 416/191 |
| 3,165,294 | A | | 1/1965 | Anderson | |
| 3,404,831 | A | | 10/1968 | Campbell | |
| 3,666,376 | A | * | 5/1972 | Damlis | 416/219 R |
| 3,778,191 | A | | 12/1973 | Brockmann | |
| 4,191,509 | A | * | 3/1980 | Leonardi | 416/219 R |
| 4,343,594 | A | * | 8/1982 | Perry | 416/193 A |
| 4,451,203 | A | * | 5/1984 | Langley | 416/215 |
| 4,451,204 | A | | 5/1984 | Pask | |
| 4,505,640 | A | * | 3/1985 | Hsing et al. | 416/97 R |
| 4,907,944 | A | * | 3/1990 | Kroger et al. | 415/65 |
| 5,131,814 | A | | 7/1992 | Przytulski et al. | |
| 5,584,658 | A | * | 12/1996 | Stenneler | 416/215 |
| 5,749,706 | A | * | 5/1998 | Maar | 416/220 R |
| 5,993,160 | A | * | 11/1999 | Bouchard et al. | 416/193 A |
| 6,364,613 | B1 | * | 4/2002 | Deallenbach et al. | 416/220 R |
| 7,080,974 | B2 | * | 7/2006 | Lejars et al. | 416/215 |

* cited by examiner

*Primary Examiner*—Ninh H Nguyen
*Assistant Examiner*—Aaron R Eastman
(74) *Attorney, Agent, or Firm*—Kenyon & Kenyon LLP

(57) ABSTRACT

A rotor of a turbo engine, e.g., a gas turbine rotor, has a rotor base member, the rotor base member having a groove extending in the circumferential direction of the rotor base member, and having a plurality of rotor blades, each rotor blade having a blade, a blade root and a blade platform positioned between the blade and the blade root, and the rotor blades being anchored in the groove of the rotor base member by their blade roots. The groove and the blade roots have a profile, such that the blade roots of the rotor blades are insertable by a tilting motion or swiveling motion into the circumferentially extending groove of the rotor base member, and in the circumferential direction, a width of the blade root corresponds approximately to a width of the blade platform of the specific rotor blade.

10 Claims, 7 Drawing Sheets

ROTOR OF A TURBO ENGINE, E.G., A GAS TURBINE ROTOR

CROSS-REFERENCE TO RELATED APPLICATIONS

The present application claims priority to Application No. 10 2004 051 116.0, filed in the Federal Republic of Germany on Oct. 20, 2004, which is expressly incorporated herein in its entirety by reference thereto.

FIELD OF THE INVENTION

The present invention relates to a rotor of a turbo engine, e.g., a gas turbine rotor.

BACKGROUND INFORMATION

Rotors of a turbo engine, e.g., gas turbine rotors, for example, have a rotor base member, as well as a plurality of rotor blades rotating with the rotor base member. The rotor blades may either be an integral component of the rotor base member, or may be anchored in one or more grooves of the rotor base member via blade roots. Rotors having integral blading are known as blisk or bling, depending upon whether the rotor base member is disk-shaped or ring-shaped. For rotors in which the rotor blades are anchored in a groove via blade roots, a distinction is made between rotors in which the blade roots of the rotor blades are secured either in so-called axial grooves of the rotor base member or in a circumferential groove of the same. An example embodiment of the present invention relates to a rotor of a turbo engine, e.g., a gas turbine rotor, in which the rotor blades are secured by their blade roots in a groove of the rotor base member extending in the circumferential direction, thus in a circumferential groove.

For rotors in which the rotor blades are secured by their blade roots in so-called circumferential grooves, the circumferential grooves have at least two diametrically opposed feed openings, in order to introduce the blade roots of the rotor blades into the corresponding circumferential groove. Conventionally, the feed openings may be formed by neckings in the region of groove-wall side pieces or limbs of the circumferential groove, the blade roots abutting with bearing flanks against the groove-wall side pieces during operation. Due to the feed openings, notch locations are formed on the groove-wall side pieces, which may be subject to a high level of stress during operation of the rotor. The service life of the rotor may thereby be reduced. Furthermore, conventionally, because of the design principle of rotor blades guided in circumferential grooves described above, the blade roots of the rotor blades, viewed in the circumferential direction, may have only approximately half the width of blade platforms of the rotor blades. Because of this, the forces which the blade roots are able to receive during operation of the rotor may be limited. The range of application of conventional rotors, in which the rotor blades are guided and secured via their blade roots in so-called circumferential grooves, may therefore be limited.

SUMMARY

An example embodiment of the present invention may provide a rotor of a turbo engine in which the groove and the blade roots have a profile, such that the blade roots of the rotor blades are insertable into the circumferentially extending groove of the rotor base member by a tilting motion or swiveling motion, a width of the blade root corresponding approximately or roughly to a width of the blade platform of the specific rotor blade in the circumferential direction.

A rotor of a turbo engine may be provided, in which the rotor blades are guided and secured via their blade roots in a circumferential groove, but in which the groove, e.g., the groove-wall side pieces, have no feed openings minimizing mechanical strength. Rather, the groove and the blade roots have a profile which may allow the blade roots to be inserted into the groove by a tilting motion. Moreover, the blade roots may be dimensioned such that, in the circumferential direction, a width of the blade roots corresponds approximately to the width of the blade platform of the specific rotor blade. Therefore, strength-minimizing feed openings in the region of the groove may be avoided, and the blade roots may be able to take up greater forces because of their markedly greater extension in the circumferential direction. The range of application of rotors in which the rotor blades are guided in circumferential grooves may thereby be expanded.

In the radial direction, a relative position between the rotor blades and the rotor base member may be defined by spacers, the spacers being positioned between groove-wall side pieces of the groove extending in the circumferential direction and the blade platforms of the rotor blades.

The spacers may be in the form of hump-like projections, a plurality of hump-like projections being positioned at a distance from each other on both groove-wall side pieces of the groove in the circumferential direction. In each case, two rotor blades may be supported with their blade platforms on two opposing projections positioned on different groove-wall side pieces. A securing element, which defines a relative position between the rotor blades and the rotor base member in the circumferential direction, may extend through in each case two opposing, hump-like projections positioned on different groove-wall side pieces.

Formed as a spacer on one groove-wall side piece of the groove may be a projection that is closed in the circumferential direction of the groove, extends in the radial direction and is an integral component of the groove-wall side piece. Positioned as a spacer on the other groove-wall side piece of the groove may be a closure ring closed in the circumferential direction or a closure ring segmented in the circumferential direction, which is insertable between the groove-wall side piece and the platforms of the rotor blades and is fixed in position by a retaining ring.

Formed as a spacer on one groove-wall side piece of the groove may be a projection that is closed in the circumferential direction of the groove, extends in the radial direction and is an integral component of the groove-wall side piece. Formed as a spacer on the other groove-wall side piece of the groove may be a projection that extends in the circumferential direction of the groove, is interrupted by at least one opening and is an integral component of the groove-wall side piece.

According to an example embodiment of the present invention, a rotor of a turbo engine includes: a rotor base member including a groove extending in a circumferential direction of the rotor base member; and a plurality of rotor blades, each rotor blade including a blade, a blade root and a blade platform positioned between the blade and the blade root, the rotor blade anchored in the groove by the blade root. The groove and the blade root are profiled so that the blade root is insertable into the groove by one of (a) a tilt motion and (b) a swivel motion, in the circumferential direction, a width of the blade root corresponding approximately to a width of the blade platform.

The rotor may be arranged as a gas turbine rotor.

A relative position between the rotor blades and the rotor base member in a radial direction may be defined by spacers.

The spacers may be positioned between groove-wall side pieces of the groove and the blade platforms of the rotor blades.

The spacers may include projections positioned on at least one side of the groove.

The projections may include a plurality of projections positioned at a distance from one another in the circumferential direction on at least one groove-wall side piece of the groove, a recess formed between adjacent projections.

The projections may include a plurality of projections positioned at a distance from one another in the circumferential direction on both groove-wall side pieces of the groove, and two rotor blades may be supported with the blade platforms on each of two opposing projections positioned on different groove-wall side pieces of the groove.

The rotor may include securing devices that define a relative position in the circumferential direction between the rotor blades and the rotor base member, and the securing devices may extend through two opposing projections positioned on different groove-wall side pieces of the groove.

The securing devices may include rivets.

The projections may be integral to the groove-wall side pieces and may extend radially outwardly starting from the groove-wall side pieces.

The spacer on one groove-wall side piece of the groove may include a projection that is closed in the circumferential direction of the groove, extends in the radial direction and is integral to the groove-wall side piece.

The spacer on another groove-wall side piece of the groove may include one of (a) a closure ring that is closed in the circumferential direction and (b) a closure ring that is segmented in the circumferential direction, is insertable between the another groove-wall side piece and the platforms of the rotor blade and is immobilized by a retaining ring.

The spacer on another groove-wall side piece of the groove may include a projection that extends in the circumferential direction of the groove, is interrupted by at least one opening and is integral to the another groove-wall side piece.

According to an example embodiment of the present invention, a gas turbine includes at least one rotor as described above.

The gas turbine may be arranged as a gas turbine of an aircraft engine.

Exemplary embodiments of the present invention are explained in greater detail below with reference to the appended Figures.

DETAILED DESCRIPTION

Figure 1:
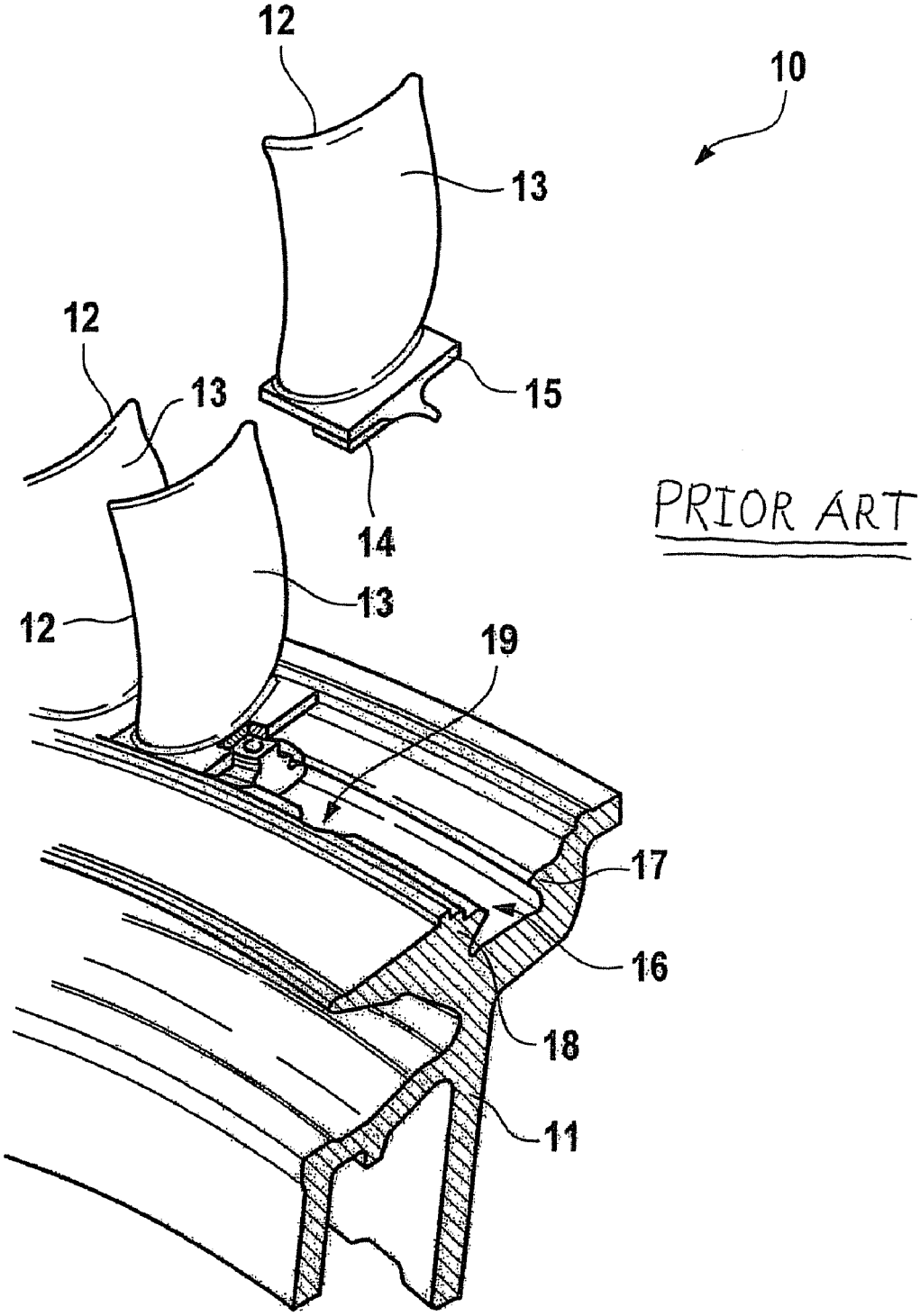
FIG. 1 is a perspective side view of a segment from a conventional gas turbine rotor.

A conventional gas turbine rotor having rotor blades guided in a circumferential groove is illustrated in FIG. 1.

FIG. 1 illustrates a segment from a gas turbine rotor 10, gas turbine rotor 10 being formed by a rotor base member 11 and a plurality of rotor blades 12. According to FIG. 1, each rotor blade 12 has a blade 13 and a blade root 14, a blade platform 15 being formed between blade 13 and blade root 14. Rotor blades 12 are secured or guided via their blade roots 14 in a groove 16 of rotor base member 11, groove 16 extending in the circumferential direction. Groove 16 extending in the circumferential direction is open radially outwardly and is bounded by two opposite groove-wall side pieces or limbs 17 and 18, respectively. To be able to insert rotor blades 12 by their blade roots 14 into circumferential groove 16, recesses or notches 19 which form feed openings for blade roots 14 are introduced into groove 16, i.e., groove-wall side pieces 17, 18. To insert rotor blades 12 into circumferential groove 16, rotor blades 12 are accordingly slipped by their blade roots 14 into circumferential groove 16 in the region of notches 19, and then shifted in the circumferential direction. After the last rotor blade 12 in gas turbine rotor 10 illustrated in FIG. 1 has been inserted, the entire set of rotor blades 12 is shifted by one half spacing of blades in the circumferential direction, so that all contact surfaces of blade roots 14 are located below supporting groove-wall side pieces 17 and 18, and therefore not in the region of a recess or notch 19 of groove-wall side pieces 17, 18. It follows directly from this that, viewed in the circumferential direction, blade roots 14 have only approximately half the width of blade platforms 15.

Figure 2:
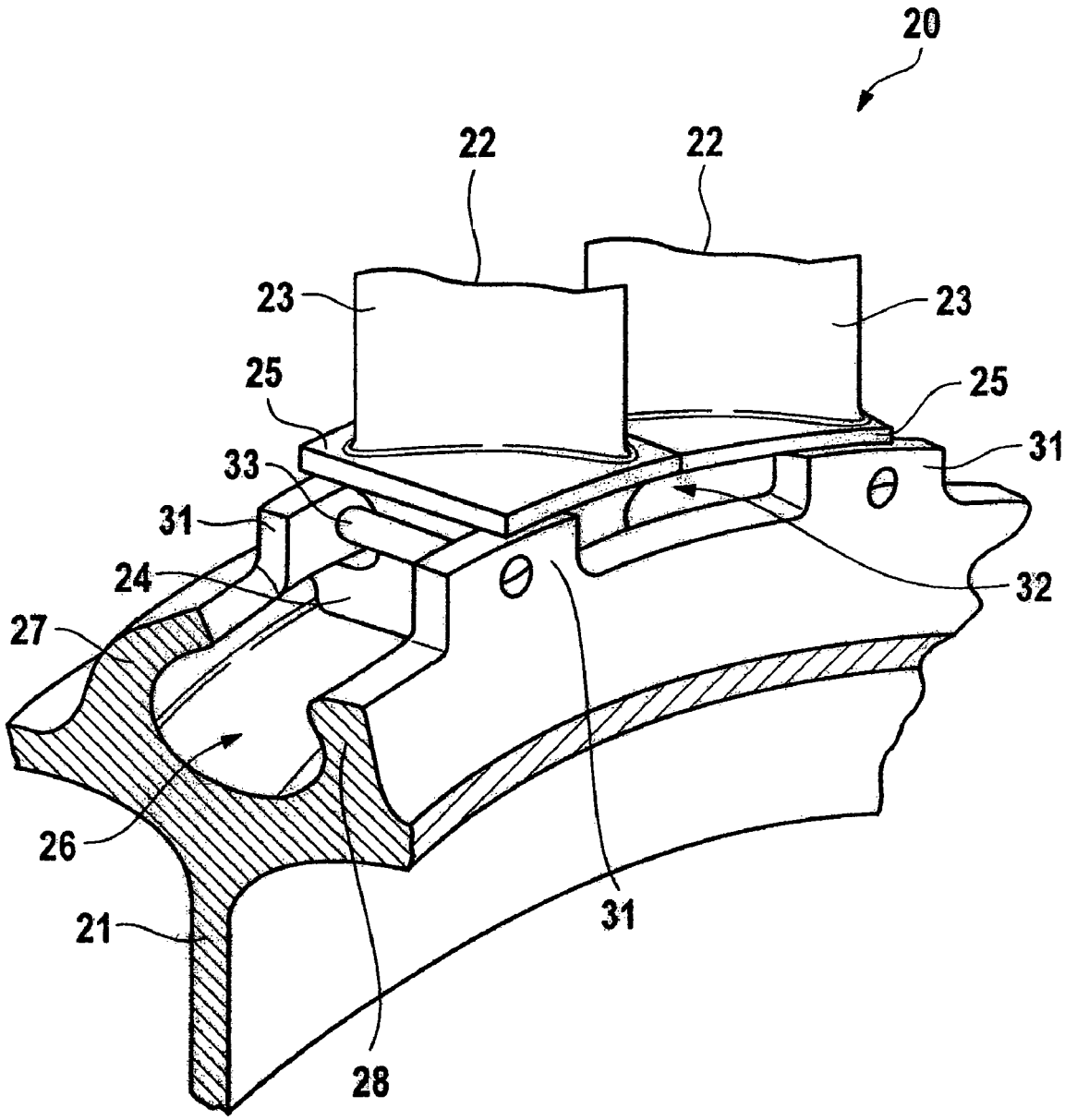
FIG. 2 is a perspective view of a segment from a gas turbine rotor of an example embodiment of the present invention.
Figure 3:
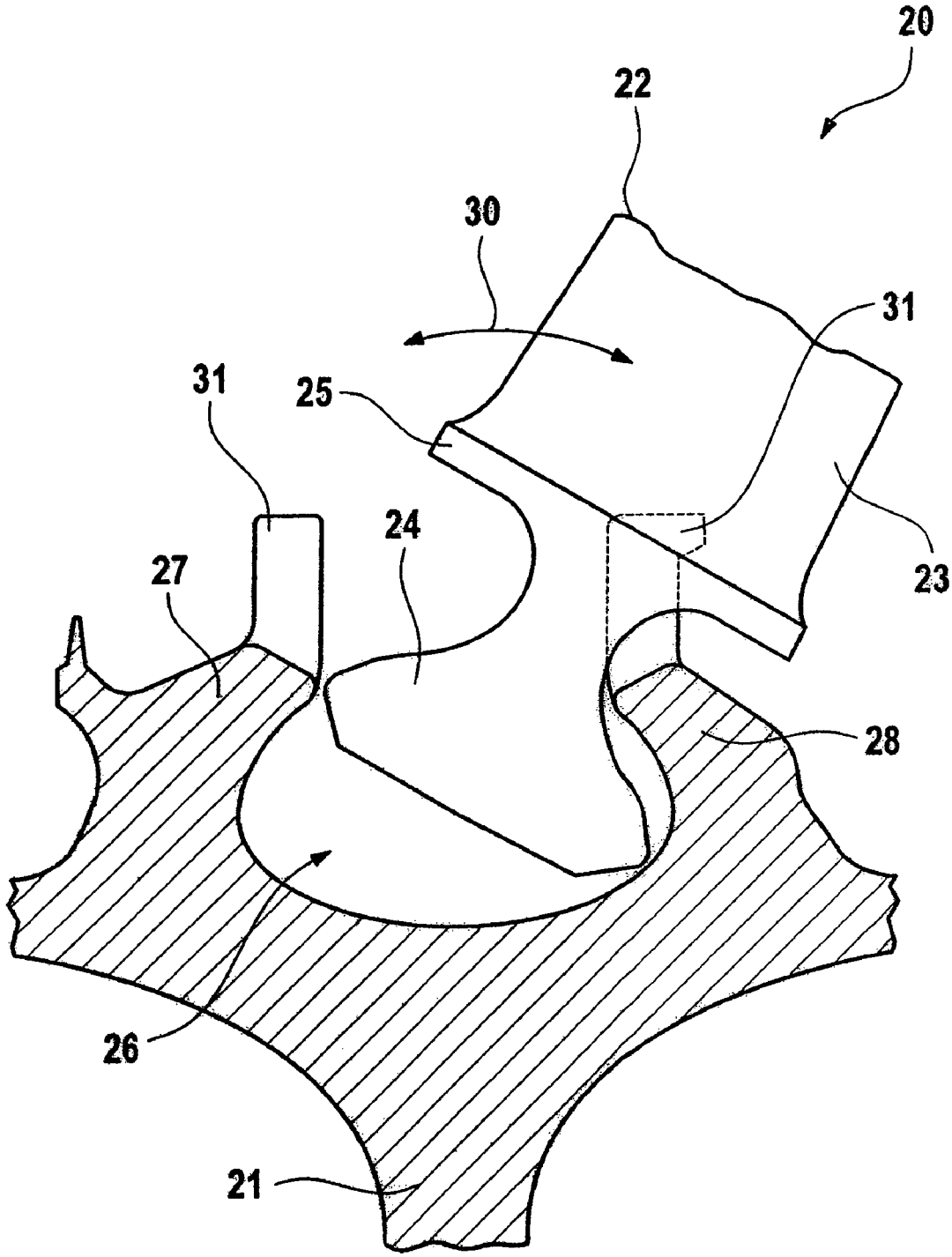
FIG. 3 is a cross-sectional view through the gas turbine rotor illustrated in FIG. 2, during the mounting of a rotor blade on a rotor base member of the gas turbine rotor.
Figure 4:
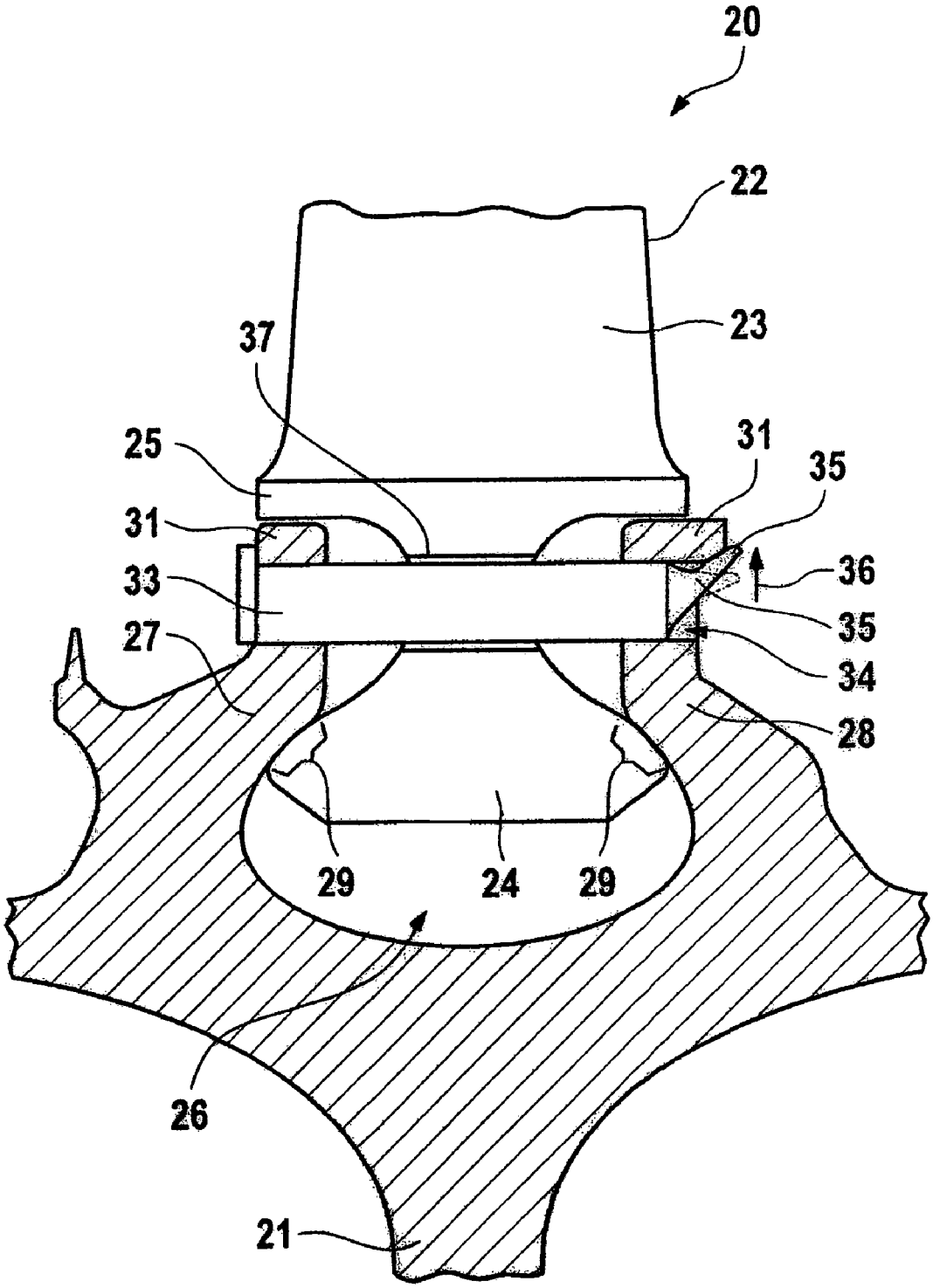
FIG. 4 is a cross-sectional view through the gas turbine rotor illustrated in FIG. 2 having a mounted rotor blade.

FIGS. 2 to 4 illustrate a gas turbine rotor 20 according to an example embodiment of the present invention, having a rotor base member 21 and a plurality of rotor blades 22. Rotor blades 22 each have a blade 23, a blade root 24 and a blade platform 25 arranged between blade 23 and blade root 24. Rotor base member 21 has a groove 26 extending in the circumferential direction and bounded by lateral groove-wall side pieces or limbs 27 and 28, respectively, rotor blades 22 being guided with their blade roots 24 in groove 26 extending in the circumferential direction. In the assembled state (see, e.g., FIG. 4), blade roots 24 abut against groove-wall side pieces 27 and 28, forming so-called bearing flanks 29.

Circumferential groove 26 and blade roots 24 have a profile, such that blade roots 24 of rotor blades 22 are insertable into circumferential groove 26 of rotor base member 21 by a tilting motion or swiveling motion, and e.g., without neckings or notches which may minimize mechanical strength being necessary in groove-wall side pieces 27 and 28, respectively. In FIG. 3, a double arrow 30 illustrates the tilting motion or swiveling motion of rotor blade 22 upon insertion of its blade root 24 into circumferential groove 26. Moreover, the profile of blade roots 24 of rotor blades 22 is dimensioned such that, in the circumferential direction, a width of blade roots 24 corresponds approximately or roughly to a width of specific blade platform 25 of specific rotor blade 22. Due to the profiling of circumferential groove 26 and of blade roots 24, strength-minimizing notches in groove-wall side pieces 27 and 28 may be omitted, and the circumferential extension of bearing flanks 29 may be markedly increased compared to conventional systems. This may increase the service life of gas turbine rotor 20.

As already mentioned, after rotor blades 22 have been pivoted by blade roots 24 into circumferential groove 26 in accordance with double arrow 30, rotor blades 22 are aligned relative to rotor base member 21 such that blade roots 24 abut against groove-wall side pieces 27 and 28 of groove 26, forming bearing flanks 29. In this context, in the radial direction, a relative position between rotor blades 22 and rotor base member 21 is defined by spacers, the spacers being positioned between groove-wall side pieces 27 and 28 extending in the circumferential direction and blade platforms 25 of rotor blades 22.

As illustrated in FIGS. 2 to 4, the spacers may be in the form of hump-like projections 31 which extend on both sides of groove 26, and accordingly are positioned in the region of both groove-wall side pieces 27 and 28. Viewed in the circumferential direction, a plurality of hump-like projections 31 are formed with distance from one another on both sides of circumferential groove 26. Therefore, in each case, a recess 32 is formed between two hump-like projections 31 adjacent in the circumferential direction. Multiple hump-like projections 31 are accordingly positioned at a distance from one another in the circumferential direction in the region of both groove-wall side pieces 27 and 28. In each case, two rotor blades 22 are supported with their blade platforms 25 on two opposite, hump-like projections 31 positioned on different groove-wall side pieces 27 and 28. Thus, FIG. 2 illustrates that each rotor blade 22 is supported at one end via its platform 25 on two hump-like projections 31 which are positioned on different groove-wall side pieces 27 and 28. At the opposite ends of blade platforms 25, they are not supported on hump-like projections 31, but rather extend in the region of a recess 32 between projections 31 set apart from each other in the circumferential direction.

Therefore, in the mounted state of rotor blades 22, the spacers, formed in the exemplary embodiment illustrated FIG. 2 to 4 as hump-like projections 31, define a radial relative position of rotor blades 22 with respect to rotor base member 21, such that rotor blades 22 are prevented from shifting radially inwardly. In the exemplary embodiment illustrated in FIGS. 2 to 4, hump-like projections 31 are each an integral component of corresponding groove-wall side piece 27 and 28, respectively, and extend radially outwardly starting from respective groove-wall side piece 27 or 28.

In the circumferential direction, the relative position between rotor blades 22 and base member 21 of gas turbine rotor 20 is defined by securing elements 33 that, in each case, extend through two opposite, hump-like projections 31 positioned on different groove-wall side pieces 27 and 28. In the exemplary embodiment illustrated in FIGS. 2 to 4, securing elements 33 may be in the form of rivets supported in bore holes 34 of hump-like projections 31. In the exemplary embodiment illustrated in FIG. 4, securing element 33, formed as a rivet, is fixed in its position by bending over a tip 35 of securing element 33 in accordance with arrow 36. Blade root 24 of each rotor blade 22, at the side at which it borders on securing element 33, has an indentation or recess 37 through which securing element 33 may be inserted, and which predefines the mounting position of rotor blades 22 in rotor base member 21.

In the exemplary embodiment illustrated in FIGS. 2 to 4, the gas turbine rotor includes a guidance of the blade roots of the rotor blades in a circumferential groove of the rotor base member, in which no strength-minimizing notches may be necessary in the groove-wall side pieces of the circumferential groove. Rather, the circumferential groove and the blade roots are profiled such that the blade roots may be introduced into the circumferential groove by a tilting motion, and the width of the blade roots in the circumferential direction corresponds approximately to the width of the respective blade platform, and therefore markedly larger bearing flanks may be made possible between the blade roots and the groove-wall side pieces compared to conventional systems. In the radial direction, the relative position between the rotor blades and the rotor disk base member is defined by spacers in the form of hump-like projections that may be an integral component of the groove-wall side pieces. In the circumferential direction, the relative position is defined by securing elements that extend through two opposite, hump-like projections positioned on different groove-wall side pieces.

An aspect of this design of a gas turbine rotor compared to conventional systems is that it may be possible to eliminate feed openings, required according to conventional systems, in the groove-wall side pieces which may reduce the mechanical strength and the service life of the blade/rotor connection. A further aspect is that markedly larger bearing flanks may be made possible between the blade roots and the groove-wall side pieces, which means the compressive load per unit area in the region of the bearing surfaces, and therefore the danger of so-called fretting, may be reduced. Gas turbine rotors hereof may be able to take up perceptibly higher forces during operation than conventional rotors, e.g., thereby increasing service life and enlarging a range of applications.

Figure 5:
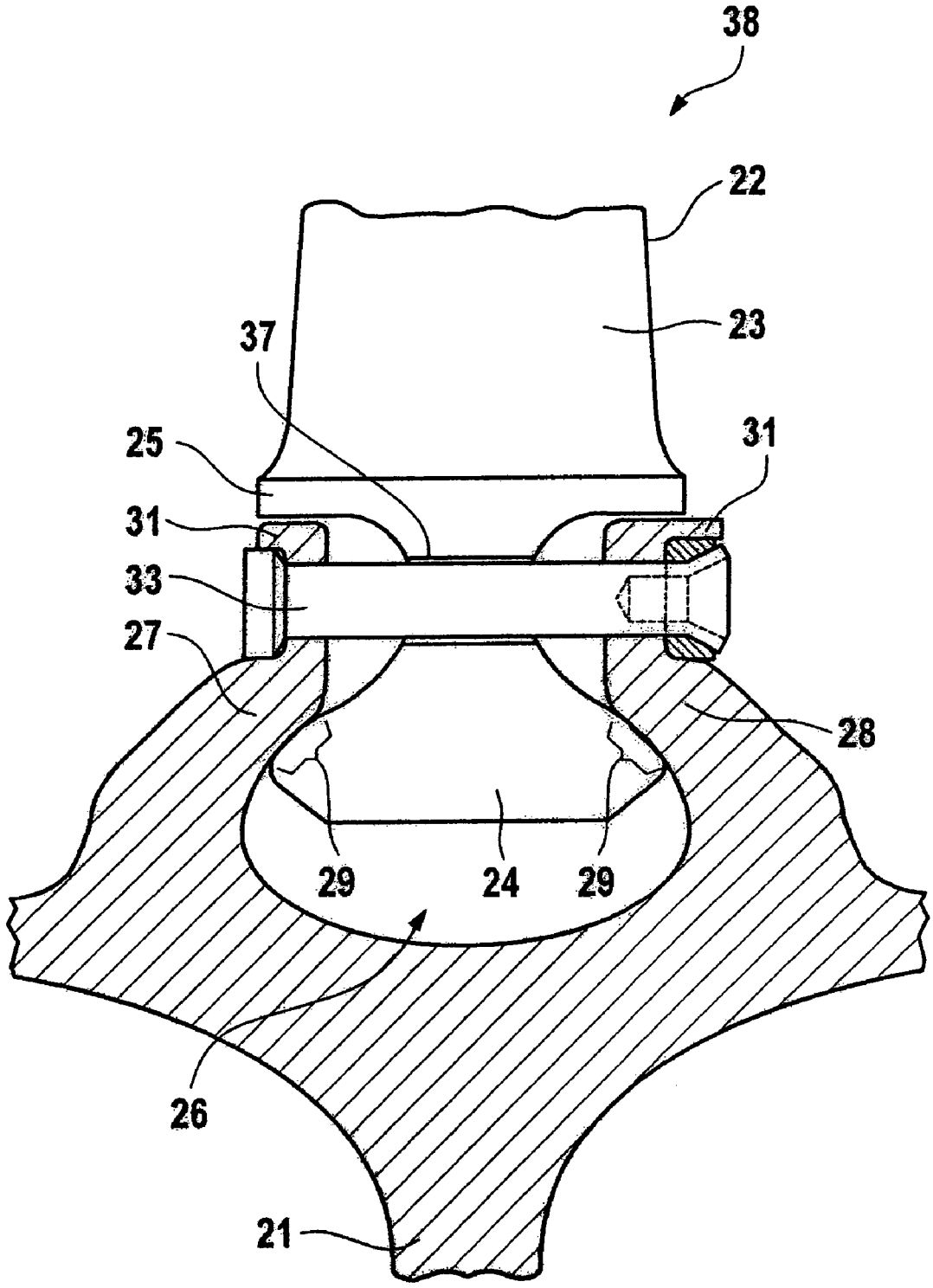
FIG. 5 is a cross-sectional view through a gas turbine rotor according to an example embodiment of the present invention having a mounted rotor blade.

FIG. 5 illustrates a gas turbine rotor 38 according an example embodiment of the present invention. The exemplary embodiment illustrated in FIG. 5 corresponds for the most part to the exemplary embodiment illustrated in FIGS. 2 to 4, so that to avoid unnecessary repetitions, the same reference numerals are used for the same or similar structural components. In the following, only those details are discussed which differentiate the exemplary embodiment illustrated FIG. 5 from the exemplary embodiment illustrated in FIGS. 2 to 4. Thus, the exemplary embodiment illustrated in FIG. 5 differs from the exemplary embodiment illustrated in FIGS. 2 to 4 only by the form of securing element 33, which, in the exemplary embodiment illustrated in FIG. 5, is implemented as a symmetrical rivet. With regard to the remaining details, reference is made to the explanations concerning the exemplary embodiment illustrated in FIGS. 2 to 4.

Figure 6:
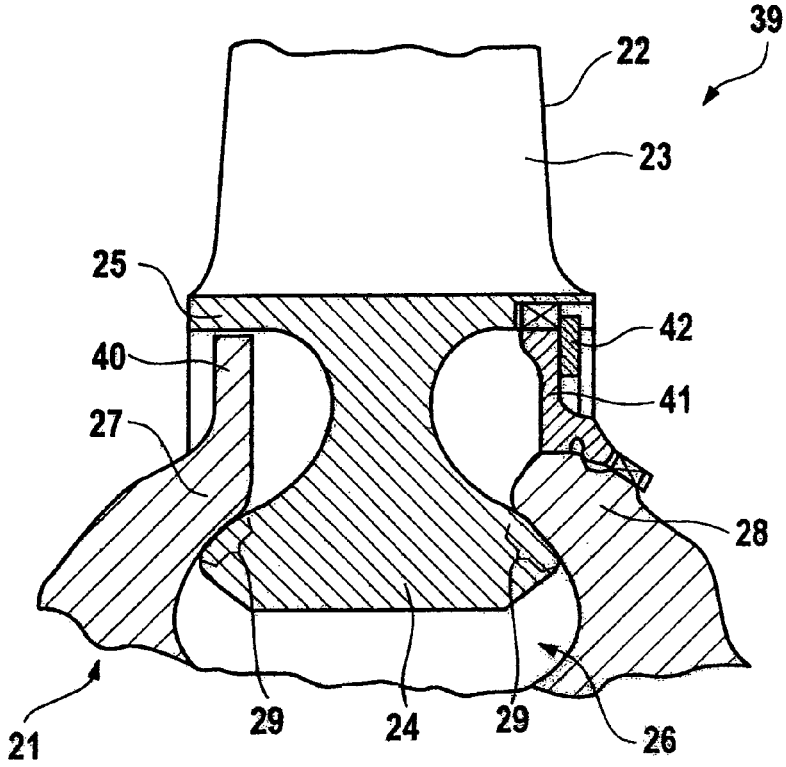
FIG. 6 is a cross-sectional view through a gas turbine rotor according to an example embodiment of the present invention having a mounted rotor blade.

FIG. 6 illustrates a gas turbine rotor 39 according to an example embodiment of the present invention. The same reference numerals are used in FIG. 6 for the same or similar structural components, and in the following, only those details are discussed which differentiate the exemplary embodiment illustrated in FIG. 6 from the exemplary embodiment illustrated in FIGS. 2 to 4. Thus, the exemplary embodiment illustrated in FIG. 6 differs from the exemplary embodiment illustrated in FIGS. 2 to 4 due to the form of the spacers which define the relative position of rotor blades 22 with respect to rotor disk base member 21 in the radial direction. In the exemplary embodiment illustrated in FIG. 6, on one groove-wall side piece 27 of circumferential groove 26, a first spacer is formed as a projection 40 closed in the circumferential direction of groove 26. Projection 40 is an integral component of groove-wall side piece 27 and, starting from groove-wall side piece 27, extends radially outwardly in the direction of platform 25 of rotor blade 22. As already mentioned, in the exemplary embodiment illustrated in FIG. 6, projection 40 is closed in the circumferential direction. Used as a spacer in the region of opposite groove-wall side piece 28 is a closure ring 41 closed in the circumferential direction or a closure ring 41 segmented in the circumferential direction, which is inserted between groove-wall side piece 28 and platforms 25 of rotor blades 22, and is fixed in this position by a retaining ring 42. Closure ring 41 provides protection against rotation and tilting for rotor blades 22.

Figure 7:
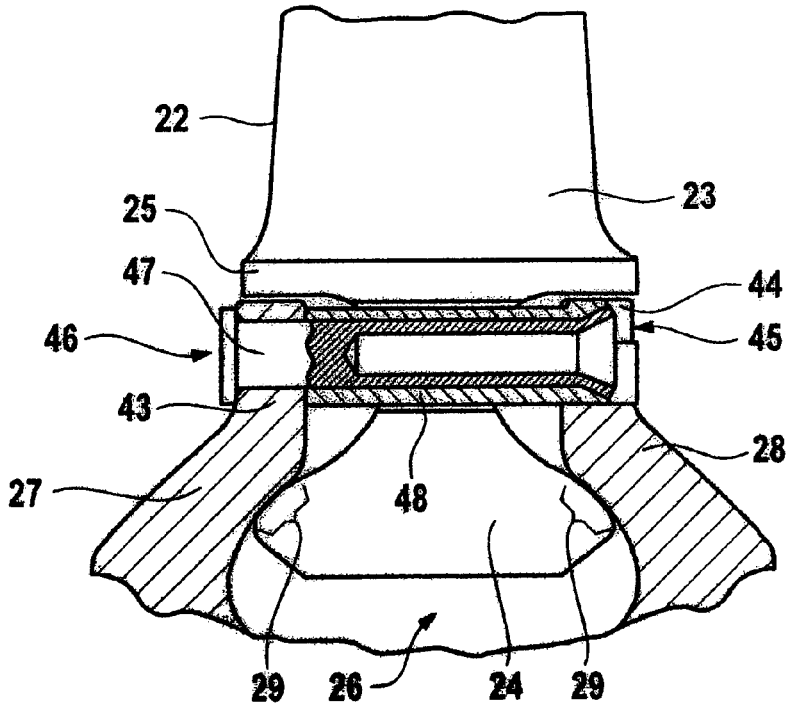
FIG. 7 is a cross-sectional view through a gas turbine rotor according to an example embodiment of the present invention having a mounted rotor blade.
Figure 8:
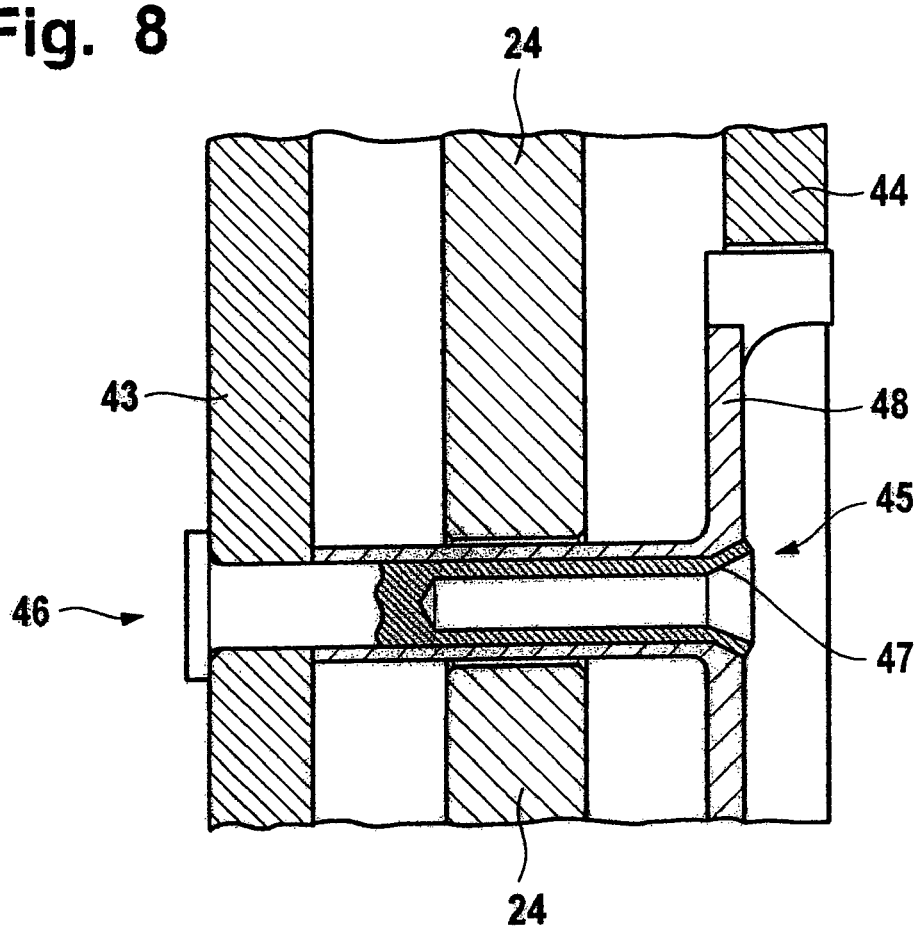
FIG. 8 is a cross-sectional view through the gas turbine rotor illustrated in FIG. 7.
Figure 9:
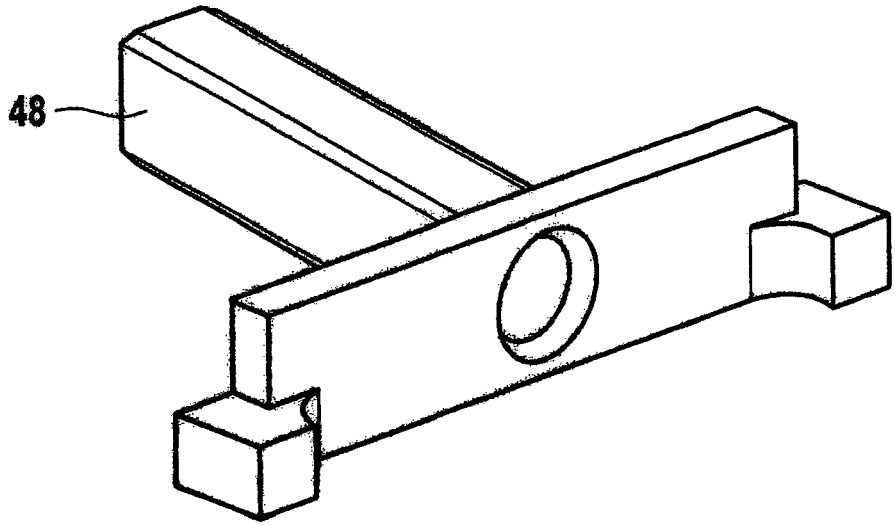
FIG. 9 is a perspective view of a closure element of the gas turbine rotor illustrated in FIGS. 7 and 8.

FIGS. 7 to 9 illustrate a gas turbine rotor 39 according to an example embodiment of the present invention. The same reference numerals are used in FIGS. 7 to 9 for the same or similar structural components, and in the following description, only those details are discussed which differentiate the exemplary embodiment illustrated in FIGS. 7 to 9 from the exemplary embodiment illustrated in FIGS. 2 to 4. Thus, the exemplary embodiment illustrated in FIGS. 7 to 9 again differs from the exemplary embodiment illustrated in FIGS. 2 to 4 due to the form of the spacers which define the relative position of rotor blades 22 with respect to rotor disk base member 21 in the radial direction. In the exemplary embodiment illustrated in FIGS. 7 to 9, on one groove-wall side piece 27 of circumferential groove 26, a first spacer is formed as a projection 43 closed in the circumferential direction of groove 26. Projection 43 is an integral component of groove-wall side piece 27 and, starting from groove-wall side piece 27, extends radially outwardly in the direction of platform 25 of rotor blade 22. As already mentioned, in the exemplary embodiment illustrated in FIGS. 7 to 9, projection 43 is closed in the circumferential direction. Used as a spacer in the region of opposite groove-wall side piece 28 is a projection 44 that extends in the circumferential direction of groove 26, is interrupted by at least one opening 45, and is an integral component of groove-wall side piece 28. In the region of each opening 45, the relative position in the circumferential direction between rotor blades 22 and base member 21 of gas turbine rotor 20 is defined by a securing element 46. Securing elements 46 are formed by a rivet 47 and a closure element 48 for opening 45, closure element 48 cooperating with rivet 47. As illustrated in FIGS. 7 and 8, securing elements 46 extend through projections 43 and 44 in the region of groove-wall side pieces 27 and 28. In the exemplary embodiment illustrated in FIGS. 7 to 9, projection 44 may be interrupted by two or four openings 45, in each case two openings 45 being diametrically opposed, and each opening 45 being closed by a closure element 48 of a securing element 46.

List of Reference Numerals

10 gas turbine rotor
11 rotor base member
12 rotor blade
13 blade
14 blade root
15 blade platform
16 groove
17 groove-wall side piece
18 groove-wall side piece
19 notch
20 gas turbine rotor
21 rotor base member
22 rotor blade
23 blade
24 blade root
25 blade platform
26 groove
27 groove-wall side piece
28 groove-wall side piece
29 bearing flank
30 double arrow
31 projection
32 recess
33 securing element
34 bore hole
35 tip
36 arrow
37 recess
38 gas turbine rotor
39 gas turbine rotor
40 projection
41 closure ring
42 retaining ring
43 projection
44 projection
45 opening
46 securing element
47 rivet
48 closure element

What is claimed is:

1. A rotor of a turbo engine, comprising:

a rotor base member including a groove extending in a circumferential direction of the rotor base member;

a plurality of rotor blades, each rotor blade including a blade, a blade root and a blade platform positioned between the blade and the blade root, the rotor blade anchored in the groove by the blade root; and securing devices that define a relative position in the circumferential direction between the rotor blades and the rotor base member;

wherein the groove and the blade root are profiled so that the blade root is insertable into the groove by one of (a) a tilt motion and (b) a swivel motion, in the circumferential direction, a width of the blade root corresponding approximately to a width of the blade platform;

wherein a relative position between the rotor blades and the rotor base member in a radial direction is defined by spacers;

wherein the spacers include projections positioned on at least one side of the groove;

wherein the projections include a plurality of projections positioned at a distance from one another in the circumferential direction on both groove-wall side pieces of the groove, a recess formed between adjacent projections on the respective groove-wall side piece, two rotor blades supported with the blade platforms on each of two opposing projections positioned on different groove-wall side pieces of the groove;

wherein the securing devices extend through the two opposing projections positioned on different groove-wall side pieces of the groove.

2. The rotor according to claim 1, wherein the rotor is arranged as a gas turbine rotor.

3. The rotor according to claim 1, wherein the spacers are positioned between groove-wall side pieces of the groove and the blade platforms of the rotor blades.

4. The rotor according to claim 1, wherein the securing devices include rivets.

5. The rotor according to claim 1, wherein the projections are integral to the groove-wall side pieces and extend radially outwardly starting from the groove-wall side pieces.

6. The rotor according to claim 1, wherein the the projections are closed in the circumferential direction of the groove, extend in the radial direction and are integral to the groove-wall side pieces.

7. A rotor of a turbo engine, comprising:

a rotor base member including a groove extending in a circumferential direction of the rotor base member; and a plurality of rotor blades, each rotor blade including a blade, a blade root and a blade platform positioned between the blade and the blade root, the rotor blade anchored in the groove by the blade root;

wherein the groove and the blade root are profiled so that the blade root is insertable into the groove by one of (a) a tilt motion and (b) a swivel motion, in the circumferential direction, a width of the blade root corresponding approximately to a width of the blade platform;

wherein a relative position between the rotor blades and the rotor base member in a radial direction is defined by spacers;

wherein the spacer on one groove-wall side piece of the groove includes a projection that is closed in the circumferential direction of the groove, extends in the radial direction and is integral to the groove-wall side piece; and wherein the spacer on another groove-wall side piece of the groove includes one of (a) a closure ring that is closed in the circumferential direction and (b) a closure ring that is segmented in the circumferential direction, is insertable between the another groove-wall side piece and the platforms of the rotor blade and is immobilized by a retaining ring.

8. The rotor according to claim 6, wherein the projections extend in the circumferential direction of the groove and are interrupted by at least one opening.

9. A gas turbine, comprising: at least one rotor including:

a rotor base member including a groove extending in a circumferential direction of the rotor base member;

a plurality of rotor blades, each rotor blade including a blade, a blade root and a blade platform positioned between the blade and the blade root, the rotor blade anchored in the groove by the blade root; and securing devices that define a relative position in the circumferential direction between the rotor blades and the rotor base member;

wherein the groove and the blade root are profiled so that the blade root is insertable into the groove by one of (a) a tilt motion and (b) a swivel motion, in the circumferential direction, a width of the blade root corresponding approximately to a width of the blade platform;

wherein a relative position between the rotor blades and the rotor base member in a radial direction is defined by spacers;

wherein the spacers include projections positioned on at least one side of the groove;

wherein the projections include a plurality of projections positioned at a distance from one another in the circumferential direction on both groove-wall side pieces of the groove, a recess formed between adjacent projections on the respective groove-wall side piece, two rotor blades supported with the blade platforms on each of two opposing projections positioned on different groove-wall side pieces of the groove;

wherein the securing devices extend through the two opposing projections positioned on different groove-wall side pieces of the groove.

10. The gas turbine according to claim 9, wherein the gas turbine is arranged as a gas turbine of an aircraft engine.

* * * * *